US005785631A

United States Patent [19]

Heidecke

[11] Patent Number: 5,785,631

[45] Date of Patent: Jul. 28, 1998

[54] EXERCISE DEVICE

[75] Inventor: Steven Heidecke, Elmhurst, Ill.

[73] Assignee: W.A.Y.S.S. Inc., Oak Brook, Ill.

[21] Appl. No.: 332,333

[22] Filed: Oct. 31, 1994

Related U.S. Application Data

[63] Continuation-in-part of Ser. No. 298,129, Aug. 30, 1994, abandoned.

[51] Int. Cl.[6] ..... A63B 22/00

[52] U.S. Cl. ..... 482/5; 482/4; 482/57; 482/901

[58] Field of Search ..... 482/4, 5, 57, 63, 482/140, 133, 142, 146, 900–902; 601/23, 24

[56] References Cited

U.S. PATENT DOCUMENTS

| | | | |
|---|---|---|---|
| 2,484,153 | 10/1949 | Chaudoir, Sr. . | |
| 2,784,591 | 3/1957 | Shoor . | |
| 3,189,344 | 6/1965 | Swarts . | |
| 3,540,435 | 11/1970 | Smith . | |
| 3,589,193 | 6/1971 | Thornton . | |
| 3,675,640 | 7/1972 | Gatts . | |
| 3,744,480 | 7/1973 | Gause et al. . | |
| 3,750,479 | 8/1973 | Gause et al. | 482/4 X |
| 3,765,245 | 10/1973 | Hampl . | |
| 3,984,666 | 10/1976 | Barron . | |
| 4,060,239 | 11/1977 | Pfleiderer et al. . | |
| 4,112,928 | 9/1978 | Patsch . | |
| 4,170,988 | 10/1979 | Krause . | |
| 4,184,678 | 1/1980 | Flavell et al. . | |
| 4,230,100 | 10/1980 | Moon . | |
| 4,244,021 | 1/1981 | Chiles, III . | |
| 4,285,515 | 8/1981 | Gezari . | |
| 4,372,551 | 2/1983 | Yurdin . | |
| 4,477,072 | 10/1984 | DeCloux . | |
| 4,613,129 | 9/1986 | Schroeder et al. . | |
| 4,746,116 | 5/1988 | Inada | 482/146 |
| 4,817,940 | 4/1989 | Shaw et al. . | |
| 4,828,257 | 5/1989 | Dyer et al. . | |
| 4,842,274 | 6/1989 | Oosthuizen et al. . | |
| 4,907,795 | 3/1990 | Shaw et al. . | |
| 5,054,774 | 10/1991 | Belsito . | |
| 5,098,089 | 3/1992 | Harrington et al. | 482/140 |
| 5,142,358 | 8/1992 | Jason . | |
| 5,233,987 | 8/1993 | Fabian et al. . | |
| 5,454,733 | 10/1995 | Blanchard et al. | 482/133 |

*Primary Examiner*—Richard J. Apley
*Assistant Examiner*—Glenn E. Richman

[57] ABSTRACT

An exercise device is provided which includes a surface for supporting a body of a user and a frame for supporting the surface above a floor. Mechanism(s) may be provided for changing the orientation of the surface relative to the floor during an exercise routine. Resistance device(s) are connected to the device for providing resistance to movement of the user. Display device(s) may be provided to display various information relating to an exercise routine to the user and to others. Computer control(s) may be included for controlling the amount of resistance provided by the resistance devices and for controlling the orientation of the support surface relative to the floor. Memory device(s) may be associated with the computer control for storing exercise routines, recording the results of performed exercise routines and other information. Input device(s) may be provided with the computer control for user input information and output device(s) may also be associated with the computer control for outputting the results of performed exercise routines and other information.

21 Claims, 4 Drawing Sheets

EXERCISE DEVICE

This application is a continuation-in-part of application Ser. No. 08/298,129 filed on Aug. 30, 1994 entitled "EXERCISE DEVICE", inventor Steven Heidecke, abandoned.

BACKGROUND OF THE INVENTION

The present invention relates to exercise devices and in particular, to a computer controlled exercise device and an exercise device which supports a user's body and, which support can be rotated to various inclined positions.

Exercise devices are well known and include bicycle type devices, treadmills, rowing devices, cross-country skiing machines, etc. Many of these devices have controls for varying a resistance of the part engaged by the user as well as some type of display device for providing information to the user. For example, U.S. Pat. No. 4,613,129 discloses an exercise bicycle which includes a visual display unit and an electronic control which displays programmed exercise routines as well as displaying time, load or resistance applied to the user, speed of exercise by the user and user's pulse rate. The automatic program mode of operation may provide routine such as simulating riding of the bicycle up and down hilly terrain only by varying the resistance of the pedals.

U.S. Pat. No. 5,054,774 discloses an exercising machine useable by a wide variety of persons in which exercise routines can be pre-programmed for individuals and results of each individual's exercise output can be displayed and stored on computer memory. An upper body support can be positioned either in a horizontal position or in an upright position.

U.S. Pat. No. 4,372,551 discloses a stress table with a resistance device attached thereto in which the body support member and resistance device can pivot between vertical and horizontal to allow the user to exercise throughout a range of angled orientations. No display device is provided, nor is there any ability to provide a preprogrammed exercise routine.

U.S. Pat. No. 3,675,640 discloses an exercise apparatus in which a pre-programmed load is provided to an exercise device used by a user and the results of the user's exercise efforts and including various physiological parameters of the user such as heart rate and rhythm, blood pressure, respiratory volume and rate are measured and stored.

SUMMARY OF THE INVENTION

In an embodiment, the present invention provides an exercise device which may include a surface for supporting a body of a user. The surface is supported above a floor by a unitary or multiple piece frame. The surface may also be mounted to the frame in such a manner so that it can change orientation relative to the floor during an exercise routine. For example, the surface may pivot or rotate forward and backward so that an angle of inclination of the surface relative to the floor may change between horizontal, vertical and forward beyond vertical. The surface may also pivot or rotate side to side about a horizontal axis or rotate up to 360° or more about a vertical axis either while the surface remains horizontal or while the surface is also pivoting about a horizontal axis. Appropriate mechanical arrangements can be provided to allow the orientation change, such as worm gears, planetary gears, hydraulic actuators, telescoping tubes, etc. The orientation changing device could be manually operated or could be automatically controlled through an electric motor, hydraulic pump, etc. Such a unit provides physiological as well as psychological benefits.

In another embodiment, the invention provides an exercise device which is capable of being computer controlled via an integral computer, or from a separate computer via instructions received from a magnetic card, disk, direct or indirect connection to a computer via modem or similar arrangements. The computer control will provide instructions to the exercise device to control the operation of the device, such as varying the resistance provided, automatically changing the orientation of the support surface, if available, displaying information to the user, varying time durations for resistance levels and orientation positions, etc. to provide an infinite variety of duration, resistance and orientation combinations. Further, the computer control may control memory devices so that the operation of the user may be recorded, either locally or at a remote site via modem, wired or wireless transmission, as well as displaying the results of the user's actions. Various types of information relating to the use can be recorded such as date and time of use, duration of use, functions performed, energy expended by the user, heart rate at select intervals, blood pressure, respiration rates, etc. In fact, a large number of parameters relating to the user's exercise use can be recorded as the exercise is performed so that the user, a coach or trainer, or a cardiac therapist, or others (such as medical personnel) will be able, through appropriate software, to view the entire exercise program, or parts or summaries thereof, and compare it to other workouts or to preprogrammed workouts and calculate or re-calculate workouts based upon parameters contained in the software for programming future exercise workouts etc.

A resistance device, engageable by the user and associated with the frame is built into the unit to provide resistance to movement of the user such as at least leg or arm movement. For example, a bicycle pedal arrangement could be provided for leg resistance, rotatable cranks for arm resistance or pivoting or sliding devices for arm, leg or back engagement.

Also provided is a display device, which may be a cathode ray tube, liquid crystal display, series of LED's or other appropriate display units for displaying selected information relating to use of the device to the user. The information displayed could include a predetermined exercise program to be followed by the user, the results of the movement of the user against the resistance device and/or various monitored physiological parameters of the user such as pulse rate, respiration rate, blood pressure, etc. The display would also show set up information as well as information input by the user through an appropriate input device.

Preferably the device includes a computer-type control with one or more microprocessors for controlling the level of resistance applied by the resistance device either in response to user input resistance levels or a pre-programmed exercise routine. Thus the control will be connected to a memory device and will also be connected to the display device and the resistance device.

In a preferred embodiment of the invention the control will also control a device for varying the orientation of the support surface so that the attitude of the user varies during the exercise routine in accordance with a pre-programmed exercise routine or user input selections.

For example, if the exercise device includes a bicycle pedal resistance device, the orientation of the support surface can vary during the exercise routine to simulate going uphill and going downhill in conjunction with varying resistance levels at the resistance device. Also, by pivoting side to side and about a vertical axis will allow the exercise device to simulate turns, both on level ground and in conjunction with simulated hills. Not only will this provide additional user interest in the use of the exercise device. Applicant believes that physiological benefits result from exercise being performed at different orientations relative to vertical, due to the varying effects of gravity on the exercise being performed. Interactive games or videos, displayed on the display device and controlled through various input devices, including buttons spaced away from the display device, can be played which would cause changes to the duration, resistance and orientation of the support surface, etc. as the game or video progresses.

Preferably the results of the exercise routine performed by the user are stored on memory, either on a non-removable hard disk type of memory or to individual floppy disks or magnetic cards which can be removed from the exercise device for further use, such as comparison to subsequent exercise routines performed by the user or for review by appropriate trainers, medical or therapy personnel. The exercise device may also include a remote transmission device such as a modem so that the results of the exercise routine can be transmitted to a remote location by either real time transmission as the exercise routine is being performed for optionally monitoring at a remote location or after the exercise routine has been completed, and other pre-programmed exercise routines can be transmitted to the exercise device for use by a user.

DETAILED DESCRIPTION OF THE PREFERRED EMBODIMENTS

Figure 2:
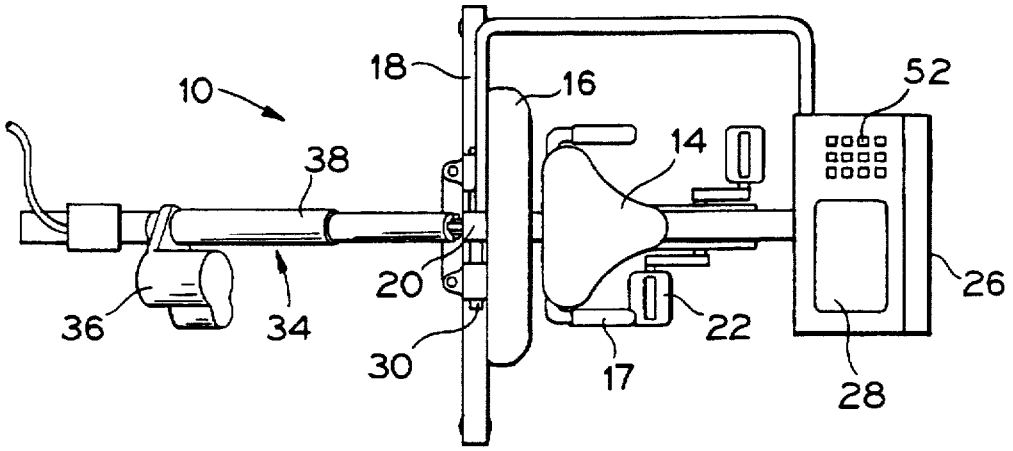
FIG. 2 is a plan view of the exercise device of FIG. 1.
Figure 1:
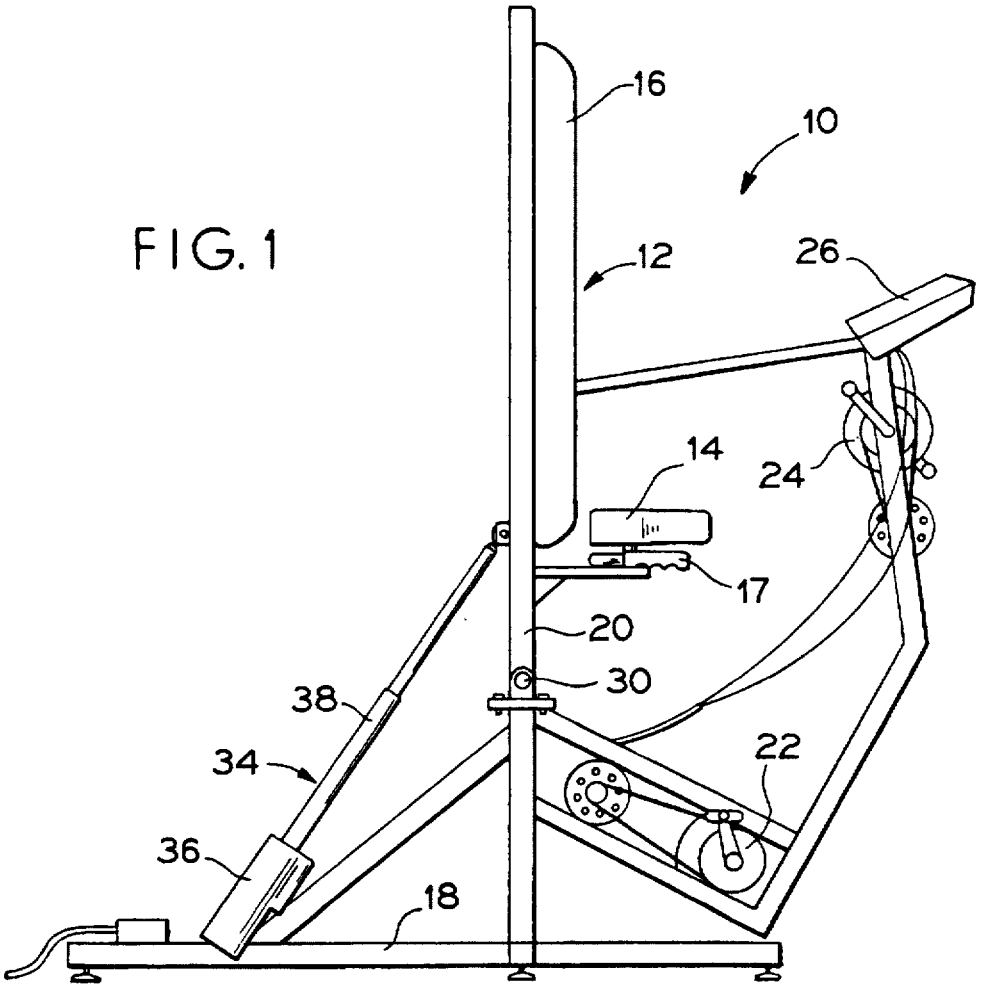
FIG. 1 is a side elevational view of an exercise device with a user support surface in a first orientation.
Figure 3:
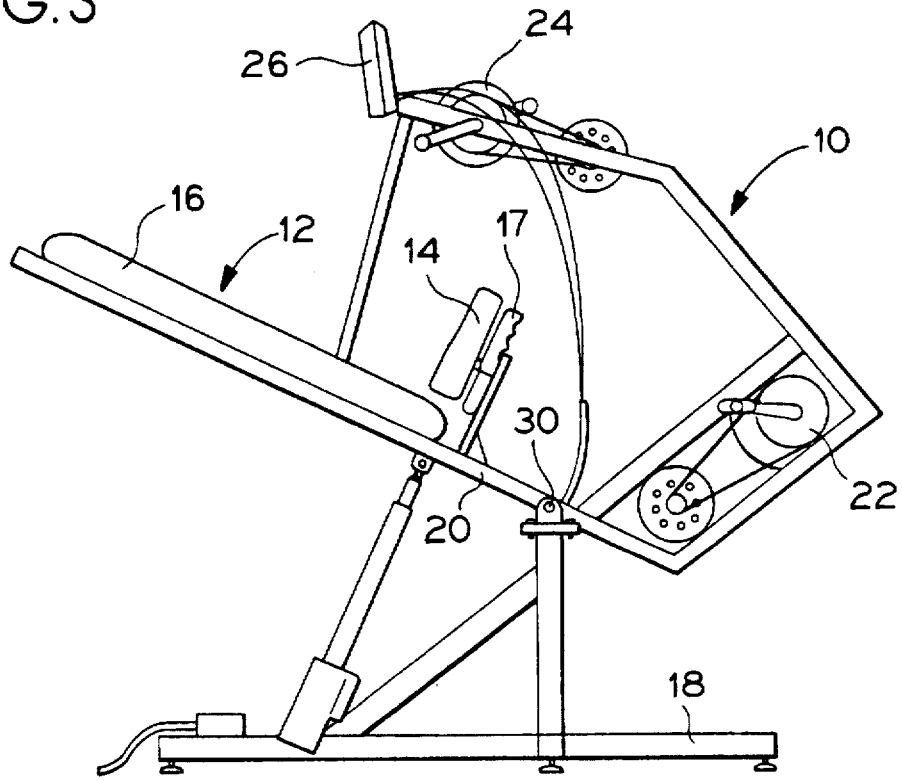
FIG. 3 is a side elevational view of the device of FIG. 1 with the user support surface in a second orientation.

FIGS. 1–3 schematically illustrate an exercise device generally at 10 which include a support surface 12 which includes a seat 14 and a back rest 16. A pair of hand grips 17 may also be provided below the seat 14 to provide the user with additional support. The support surface 12 is carried on a main frame 18 which supports the surface above a floor. The back rest 16 could be a foam covered board or could be a contoured back rest, as desired. The seat 14 could be formed integrally with the back rest 16 or it could be formed separately. The hand grips 17 may be secured to a formed integrally with the frame 18 and may wrap around to be directed in a direction that a user would face when seated on the seat 14. Depending from the back rest 16 is a sub-frame 20 which carries on it a device 22 for providing resistance to the legs of a user. Alternatively, or in combination, a resistance device 24 may be provided for providing resistance to arm movement of the user. The seat 14 should be adjustable relative to the position of the resistance devices 22, 24 to accommodate different sized users.

In the embodiment illustrated in FIGS. 1–3, the resistance device is illustrated as comprising a rotatable pedal or crank structure as is common in some exercise devices to simulate bicycle riding or an arm cranking motion. Other types of resistance devices are known such as pivoting devices, sliding devices, weights on cables or levers, braking motors, alternators, tightenable belts, friction rollers, etc. and could be substituted for the devices illustrated while still being within the scope of the present invention. The resistance devices may be adjusted manually, manually through electrical switches, or by means of a computer type control as described below.

Secured to the sub-frame 20 is a display unit 26 which includes a display screen 28 for displaying selected information relating to the use of the device to the user. The display device could be a cathode ray tube, a liquid crystal display, including flat screens, helmets, goggles, etc., a series of LED displays, a combination of two or more of such displays, or other appropriate display types such as analog meters. The display unit 26 may also include an audible display device for providing various information, sound effects, music, etc. to the user.

The entire support surface 12, sub-frame 20, resistance devices 22, 24 and display unit 26 is pivotally attached to the main frame 18 at a pivot point 30 such that the orientation of the surface 12 relative to the floor may be changed. Depending upon the particular type of exercise device and resistance device utilized, an appropriate orientation changing device or mechanism may be provided for altering the orientation of the support surface 12 relative to the floor. For example, a manually actuated crank could be utilized which could have a crank handle, a large wheel or other appropriate manually graspable portion to allow for rotation of the support surface 12 relative to the main frame 18. Appropriate reducing gears and the like could be utilized as would be apparent to a person of ordinary skill in the art.

Alternatively, and preferably, an automated mechanism or actuating device 34 which may include an electric motor 36 driving a linear actuator 38 which is secured to the sub-frame 20 could be utilized to provide the relative rotation of the support surface 12 relative to the main frame 18. The motor 36 should be secured to the frame 18. Other types of devices including hydraulic actuators, helical screws operating through appropriate pivoting linkages, threaded drive-shaft and meshing gear, etc. could be utilized as would be apparent to one of ordinary skill in the art to cause relative movement between the support surface and its sub-frame 20 and the main frame 18. The automated mechanism 34 could be manually controlled by a user through appropriate switches, or could be automatically controlled by a computer control as described below.

Figure 7:
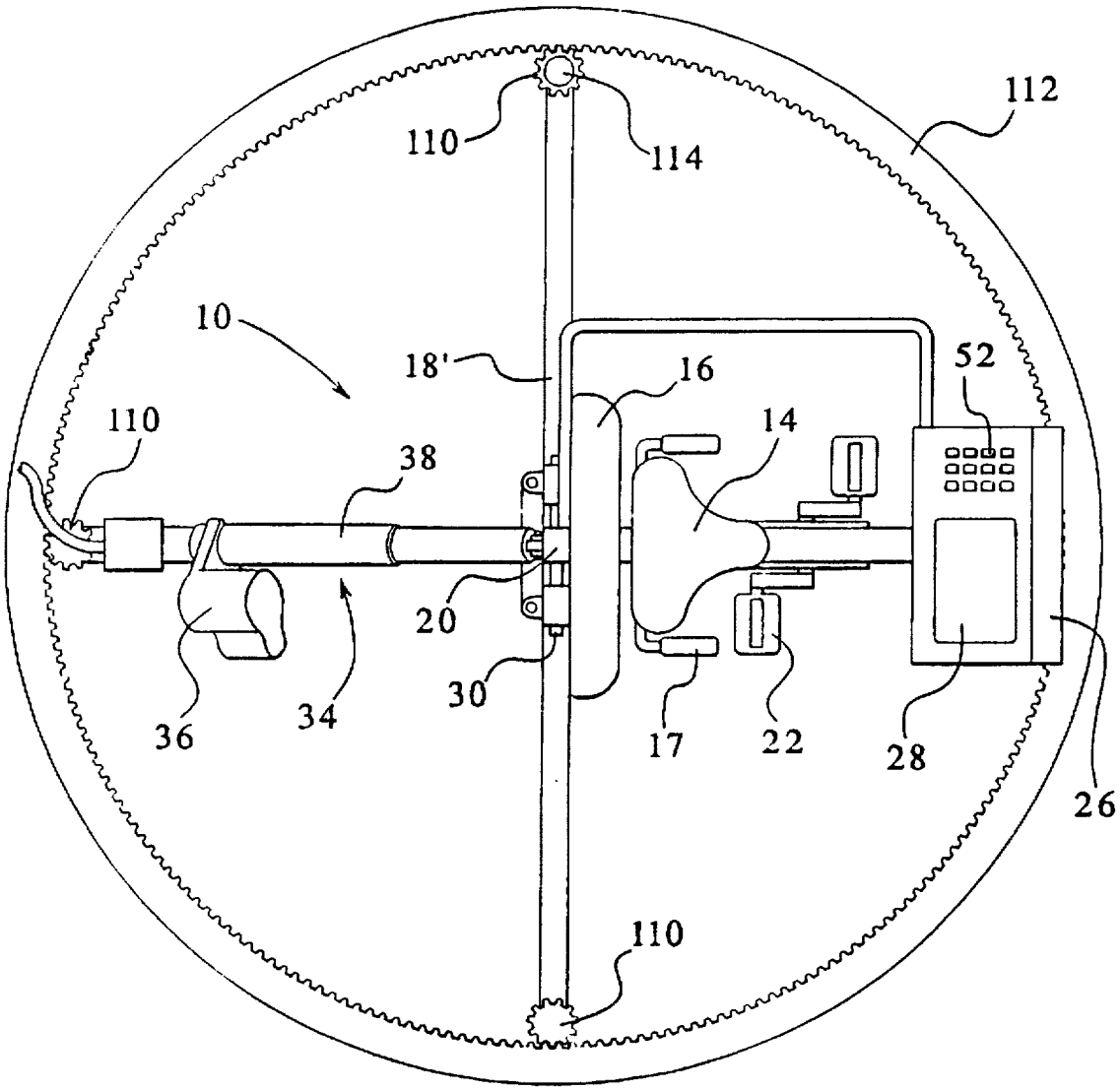
FIG. 7 is a plan view of an alternate embodiment of the exercise device of FIG. 1.

Although the preferred embodiment shows the support surface pivoting about a single horizontal axis to provide front to rear tilting relative to the floor, other types of movement and changes in orientation of the support surface relative to the floor are contemplated by the present invention. For example, FIG. 7 illustrates an orientation changing device for causing the exercise device to rotate about a vertical axis. The main frame 18' may include horizontally disposed gears 110 at each end of the frame to mesh with another part of the frame 18', in this case, a large encircling gear 112. One or more of the end gears 110 may be driven by a motor 114 so that the entire frame 18' would rotate about a vertical axis through a full 360° range and beyond. The motor 114 may be a reversible motor and could be controlled by a computer control as described below. Other types of mechanical arrangements such as a powered gimbal arrangement, etc. could also be utilized to effect movement of the support surface about and along one, two or all of the three perpendicular axes. Actuators, rack gears or other arrangements, etc. could be provided to translate the frame linearly along any of the axes. In this fashion, the orientation of the support surface relative to the floor could be infinitely modified to put the support surface in any relative position desired.

Figure 4:
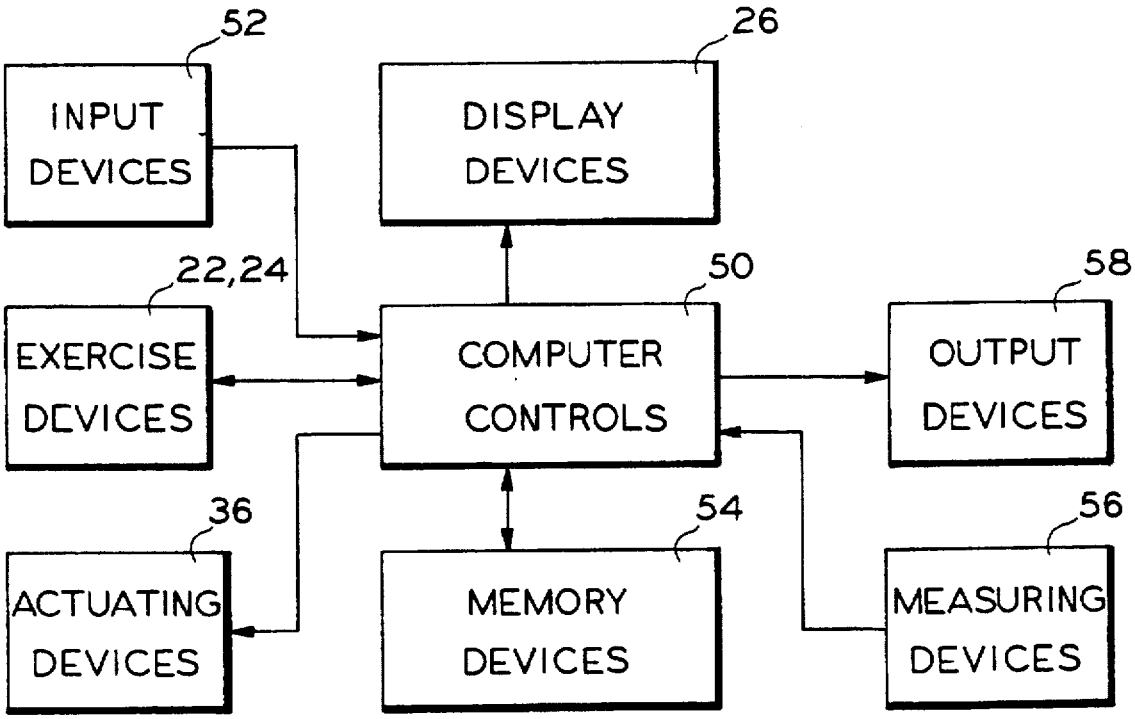
FIG. 4 is a schematic block diagram of the computer hardware and other devices utilized with the exercise device of FIG. 1.

A schematic illustration of a preferred computer control 50 including one or more microprocessors for the exercise device 10 is illustrated in FIG. 4. In this figure the computer control 50 is shown schematically for receiving signals from and sending signals to various devices. An input device is shown schematically at 52 which could include one or more of keyboard input, touch screen input, an infra red or other wireless receiver, manually activated switch, including movement or orientation sensitive switch, an RS232 connection to some other input device such as another computer directly or through a modem and phone line, or some data storage device, etc. Also, a memory device 54 is illustrated as providing an input signal to and receiving an output signal from the computer control 56. The computer control 50 provides an output signal to the display device 26.

The memory device 54 may include both RAM and ROM memory as well as other types of storage devices such as hard disks, CD ROMS, magnetic tape or card devices, etc. A user, by appropriate inputs at the input device 52 will cause the computer control 50 to begin operation, perhaps by obtaining data from the memory device and displaying various information on the display device 26. For example, a user may input the user's code number and the computer control 50 will interrogate the memory device 54 to load a pre-selected exercise routine and provide a display of the routine on the display device 26. The user, by manipulation of the input device 52 could confirm selection of the individualized pre-programmed exercise routine, could modify the pre-programmed exercise routine, could generate a custom designed exercise routine or could select a generic pre-programmed exercise routine or could terminate operation of the exercise device, which, if done during an exercise routine could also operate the actuating device 34 to re-orient the exercise device to an unloading position.

The schematic diagram also illustrates that various measuring devices 56 may be utilized to provide a signal to the computer control 50. Such measuring devices could include a pulse rate counter, a blood pressure sensor, respiration sensors and other similar types of physiological sensors as are well known to those of skill in the art. These devices would be attached to the user as known and the output from the measuring devices 56 could be directed through the computer control 50 to the display device 26 and to the memory device 54. Other measuring devices 56 could provide input to the computer control regarding the exercise device 22 including resistance level, degrees of orientation of support surface, R.P.M. or speed of exercise, number of repetitions, duration, etc. The measuring devices 56 attached to the user may provide input to the control to modify the exercise routine, such as by changing the resistance level or surface orientation to keep a pulse rate within a predetermined target zone, maintain other physiological parameters within a predetermined zone, or terminating operation if a dangerous condition is measured.

Once the user has selected an appropriate exercise routine, or, even without selecting an exercise routine, the user would begin preforming by applying a force against one or both of the resistance devices 22, 24 thus expending energy. The programmed routine may begin by user activation such as pressing a "start" button, beginning movement of the resistance device, etc. The results of the user's force against the selected exercise device would be transmitted to the computer control 50 for display on the display device 26 and for temporary or permanent storage at the memory device 54. As appropriate, the information could also be directed to an output device 58 such as to an external storage device, over a modem/telephone line to a remote location, to a remote display or to a printer. As the user works through a pre-programmed exercise routine, or in response to appropriate user inputs through the input device 52, the computer control 50 will send appropriate signals to the resistance device 22, 24 to vary the resistance to the leg, arm or other movement of the user. Also, the computer control 50 may supply an appropriate signal to the actuating device 34 and/or motor 114 to selectively cause the support surface 12 to change orientation relative to the floor if the exercise device is so equipped.

For example, in the particular embodiment illustrated, the resistance device 22 simulates bicycle riding and the exercise routine or interactive game or display(s) could simulate hill climbing, level surface riding and downhill riding. The display device and input devices could be used to provide a virtual reality and/or interactive environment so that actions or movements of the user cause modification of the program. As the program progresses through the various stages, the orientation of the support surface could be automatically changed to conform to the resistance level simulated to give the user the actual sensation of going uphill or downhill. Also the sensation of turning could be accommodated by rotating side to side (pivoting about a horizontal axis which goes from front to back of the device) and turning around a vertical axis. Translation of the device, vertically or horizontally could also be used to further enhance the simulation.

Further, Applicant believes that various physiological benefits are achieved in conducting various resistance exercises with or without the assistance of gravity and by varying the effect of gravity which comes from varying the orientation of the user's body who is performing the exercise. Thus, in cycle type exercise devices and in other types of exercise devices as well, the changing of the orientation of the support surface relative to the floor will provide differing exercise benefits.

As mentioned above, the results of the exercise routine performed by the user can be stored in the memory device 54, which includes storage on a fixed disk device or on removable floppy disks, or magnetic cards and can be sent to the output device 58 for transmission to a remote location. The results of the exercise program can be used in subsequent exercise routines for comparison purposes and/or can be reviewed by appropriate medical and therapy personnel to assist the user in developing further exercise programs.

The information stored on the memory device 54 and sent through the output device 58 can include the actual level of intensity, duration of exercise at that level, the angle of orientation (vertical and/or horizontal) of the support surface relative to the floor or original position, plus measured information such as blood pressure, heart rate, respiration rate, etc.

Another type of output device 58 could be an audible or visual alarm which is operated by the computer control 50 in the event one of the measuring devices 56 measures a physiological parameter outside of a desired range, such as excessive pulse rate or blood pressure. In such an event, the computer control 50 might also terminate all resistance and operate the actuating device 34 to re-orient the exercise device 10 to an unloading position.

Appropriate data processing programs can be utilized to display the various parameter and exercising efforts of the user, to compare two or more exercise routines, to provide averages of various collected data, etc.

Figure 5:
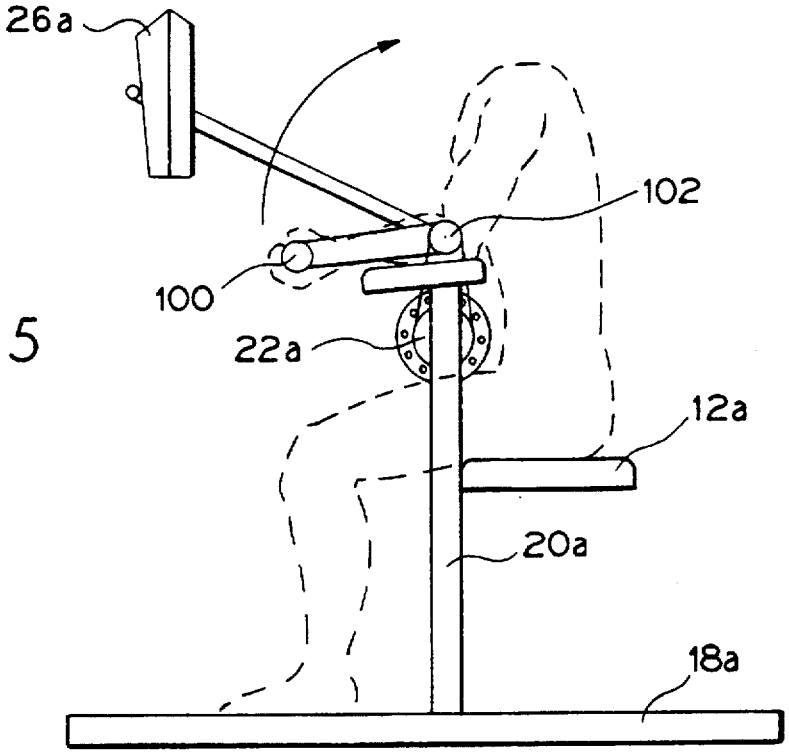
FIG. 5 is a schematic side elevational view of an alternate embodiment of an exercise device in accordance with the invention.
Figure 6:
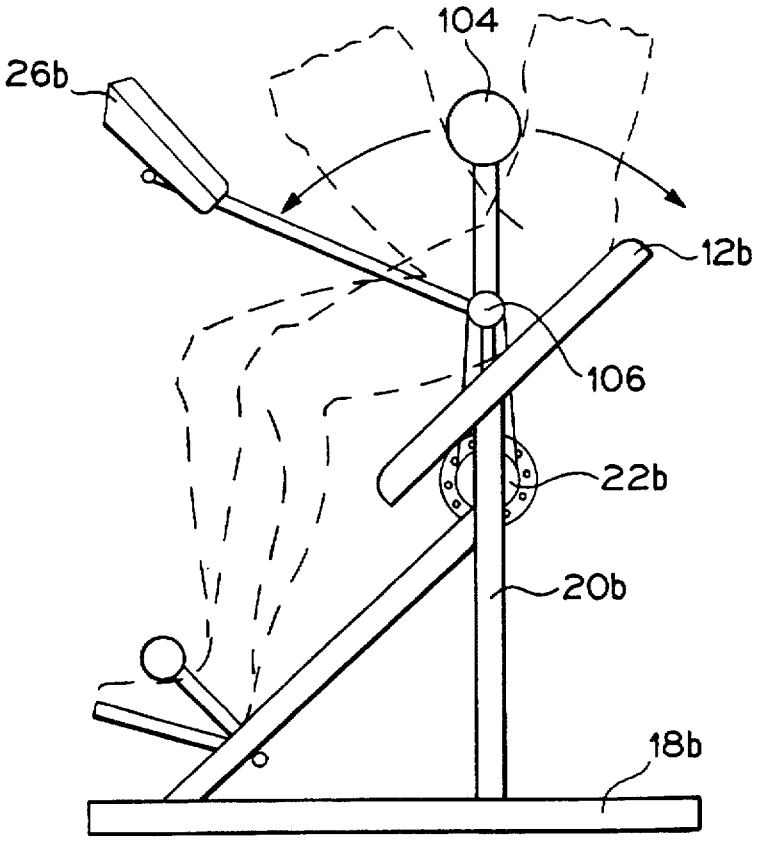
FIG. 6 is a schematic side elevational view of an alternate embodiment of an exercise device in accordance with the invention.

FIGS. 5 and 6 schematically illustrate other types of exercise devices which embody various principles of the present invention. For example, in FIG. 5, an arm exercising device is illustrated in which a hand grip 100 is pivoted about a pivot point 102 which is connected to a resistance device 22*a*. A user is supported on a support surface 12*a* which is mounted on a sub-frame 20*a* which is connected to a main frame 18*a*. A display device 26*a* is provided which can include a display screen and an input device as described above.

FIG. 6 shows a device for exercising by means of movement at the hip to provide exercise for back and stomach muscles in which a padded cross bar 104 is engaged either by the stomach or back of a user and is pressed forward or backwards about a pivot point 106 and in which a resistance device 22*b* provides resistance against movement of the bar 104. Other similar components of the exercise device are provided with common reference numbers with a small b suffix.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. An exercise device comprising:

a surface for supporting a body of a user;

a frame for supporting said surface above a floor;

means for changing an orientation of said surface relative to said floor during an exercise routine comprising a powered actuating device;

means, engageable by said user and associated with said frame, for providing resistance to movement of said user;

means for changing an amount of resistance provided by said means for providing resistance;

means for displaying selected information relating to use of said device by said user;

a computer control connected to operate said means for changing an orientation and an amount of resistance provided by said means for providing resistance;

said computer control having means for inputting and accepting instructions for operating said means for changing an orientation and an amount of resistance and means for storing said instructions;

whereby, said computer control is operable to change the orientation of said surface and for amount of resistance during an exercise routine.

2. An exercise device according to claim 1, wherein said information comprises an exercise program to be followed by said user.

3. An exercise device according to claim 1, wherein said information comprises results of said movement of said user against said means for providing resistance.

4. An exercise device according to claim 3, further including means for transmitting said results to a location remote from said device.

5. An exercise device according to claim 1, further including means for transmitting said information to a location remote from said device.

6. An exercise device according to claim 1, wherein said means for changing orientation of said support surface permits said surface to be adjustably oriented through a range from horizontal to vertical.

7. An exercise device according to claim 1, wherein said means for changing orientation of said support surface permits said surface to be adjustably oriented about a vertical axis.

8. An exercise device according to claim 7, wherein said means for changing orientation permits said surface to be adjustably oriented through a range of at least 360 degrees in either direction about said vertical axis.

9. An exercise device according to claim 1, wherein said means for changing orientation of said support surface permits said surface to be adjustably oriented along an axis.

10. An exercise device according to claim 1, wherein said means for changing orientation of said support surface comprises a means for changing the orientation of said support surface about each of three perpendicular axes.

11. An exercise device according to claim 1, wherein said means for changing orientation of said support surface comprises a means for translating said support surface along at least one of three perpendicular axes.

12. An exercise device according to claim 1, wherein said surface comprises a seat and back rest.

13. An exercise device according to claim 1, wherein said means for changing orientation of said support surface comprises a connection between said surface and said frame, permitting a forward and rearward tilting of said user positioned on said surface.

14. An exercise device according to claim 1, wherein said means for providing resistance comprises pedals for engagement by feet of said user, said pedals rotatably connected to said frame.

15. An exercise device according to claim 1, wherein said frame comprises a main frame engageable with the floor and a sub-frame attached to said surface and connecting means between said main frame and sub-frame to permit movement therebetween.

16. An exercise device according to claim 1, further including manually graspable support means for providing a user additional support.

17. An exercise device according to claim 16, wherein said support surface includes a seat and said manually graspable support means comprises hand grips positioned below said seat.

18. An exercise device according to claim 17, wherein said hand grips are secured to said frame and wrap around to be directed in a direction that a user would face when seated on said seat.

19. An exercise device according to claim 1, wherein said computer control includes means for changing the orientation in conjunction with changing the amount of resistance.

20. An exercise device according to claim 1, wherein said computer control includes means for automatically changing the orientation of the support surface to conform to the amount of resistance provided.

21. An exercise device comprising:

a surface for engaging and supporting a body of a user, while leaving the user's feet and legs free to engage a resistance device;

a frame for supporting said surface above a floor;

a powered actuating device for changing an orientation of said surface relative to said floor during an exercise routine;

said resistance device being engageable by said user and associated with said frame;

means for changing a level of resistance provided by said resistance device;

means for displaying selected information relating to use of said device by said user;

a computer control connected to operate said powered actuating device and said means for changing a level of resistance in a dependent fashion;

said computer control having means for inputting and accepting instructions for operating said actuating device and said means for changing a level of resistance and means for storing said instructions;

whereby, said computer control is operable to change both the orientation of said surface and the level of resistance in harmony during an exercise routine.

* * * * *